US007561153B2

(12) United States Patent
Lee et al.

(10) Patent No.: US 7,561,153 B2
(45) Date of Patent: Jul. 14, 2009

(54) APPARATUS AND METHOD OF DRIVING PLASMA DISPLAY PANEL

(75) Inventors: Jae-Chan Lee, Daegu (KR); Bon-Cheol Koo, Daegu (KR)

(73) Assignee: LG Electronics Inc., Seoul (KR)

( * ) Notice: Subject to any disclaimer, the term of this patent is extended or adjusted under 35 U.S.C. 154(b) by 567 days.

(21) Appl. No.: 10/565,636

(22) PCT Filed: Jul. 23, 2004

(86) PCT No.: PCT/KR2004/001866

§ 371 (c)(1),
(2), (4) Date: Jun. 27, 2006

(87) PCT Pub. No.: WO2005/010857

PCT Pub. Date: Feb. 3, 2005

(65) Prior Publication Data

US 2007/0024609 A1 Feb. 1, 2007

(30) Foreign Application Priority Data

Jul. 24, 2003 (KR) ..... 10-2003-0050891

(51) Int. Cl.
*G09G 5/00* (2006.01)

(52) U.S. Cl. ..... 345/208; 345/204; 345/80; 345/68; 345/67; 315/169.1; 315/169.4

(58) Field of Classification Search ..... 345/37, 345/55, 60, 63, 66–68, 80, 204, 206, 208, 345/211, 1.2, 3.2, 3.3; 315/169.1–169.4
See application file for complete search history.

(56) References Cited

U.S. PATENT DOCUMENTS 6,034,482 A * 3/2000 Kanazawa et al. ..... 315/169.4
6,061,040 A * 5/2000 Onodera et al. ..... 345/67
6,738,033 B1 * 5/2004 Hibino et al. ..... 345/60
6,756,742 B2 * 6/2004 Tsai et al. ..... 315/169.3
7,136,032 B2 * 11/2006 Onozawa et al. ..... 345/60

(Continued)

FOREIGN PATENT DOCUMENTS

CN 1409285 4/2003

(Continued)

OTHER PUBLICATIONS

International Search Report dated Nov. 1, 2004.

(Continued)

*Primary Examiner*—Haissa Philogene
(74) *Attorney, Agent, or Firm*—Ked & Associates, LLP

(57) ABSTRACT

An apparatus and method of driving a plasma display panel for reducing power consumption is disclosed. In the apparatus, a sub-field mapping unit maps a data inputted from the exterior thereof onto a sub-field pattern stored in advance. An APL calculator calculates an APL corresponding to said data inputted from the exterior and generating an information about the number of sustaining pulses corresponding to the calculated APL. A load detector receives the mapped data from the sub-field mapping unit to generate a control signal in response to whether or not a data for each sub-field is supplied. A waveform generator controls a sustaining pulse applied to a panel in response to said information about the number of sustaining pulses and said control signal.

11 Claims, 6 Drawing Sheets

U.S. PATENT DOCUMENTS

| | | | | |
|---|---|---|---|---|
| 7,471,265 | B2 * | 12/2008 | Kim et al. | 345/60 |
| 2004/0183764 | A1 * | 9/2004 | Kim et al. | 345/88 |

FOREIGN PATENT DOCUMENTS

| | | |
|---|---|---|
| JP | 09-034403 | 2/1997 |
| JP | 10-177365 | 6/1998 |
| JP | 2000-098972 | 4/2000 |
| KR | 10-2001-0096310 | 11/2001 |

OTHER PUBLICATIONS

European Search Report dated Feb. 9, 2006.
Chinese Office Action dated Sep. 7, 2007.

* cited by examiner

APPARATUS AND METHOD OF DRIVING PLASMA DISPLAY PANEL

TECHNICAL FIELD

This invention relates to a plasma display panel, and more particularly to an apparatus and method of driving a plasma display panel that is adaptive for reducing power consumption.

BACKGROUND ART

Generally, a plasma display panel (PDP) displays a picture by utilizing a visible light emitted from a phosphorus material when an ultraviolet ray generated by a gas discharge excites the phosphorus material. The PDP has advantages in that it has a thinner thickness and a lighter weight in comparison to the existent cathode ray tube (CRT) and is capable of realizing a high resolution and a large-scale screen.

Referring to FIG. 1 and FIG. 2, a conventional three-electrode, AC surface-discharge PDP includes scan electrodes Y1 to Yn and sustain electrodes Z provided on an upper substrate 10, and address electrodes X1 to Xm provided on a lower substrate 18. Discharge cells 1 of the PDP are provided at intersections among the scan electrodes Y1 to Yn, the sustain electrodes Z and the address electrodes X1 to Xm. The address electrodes are driven by an address driver (X-DRIVER), the scan electrodes are driven by a scan driver (Y-DRIVER) and the sustain electrodes are driven by a sustain driver (Z-DRIVER).

Each of the scan electrodes Y1 to Yn and the sustain electrodes Z includes a transparent electrode 12, and a metal bus electrode 11 having a smaller line width than the transparent electrode 12 and provided at one edge of the transparent electrode 12. The transparent electrode 12 is usually formed from indium-tin-oxide (ITO) on the upper substrate 10. The metal bus electrode 11 is usually formed from a metal on the transparent electrode 12 to thereby reduce a voltage drop caused by the transparent electrode 12 having a high resistance. On the upper substrate 10 provided with the scan electrodes Y1 to Yn and the sustain electrodes Z, an upper dielectric layer 13 and a protective film 14 are disposed. Wall charges generated upon plasma discharge are accumulated onto the upper dielectric layer 13. The protective film 14 protects the electrodes Y1 to Yn and Z from a sputtering generated upon plasma discharge, and enhances an emission efficiency of secondary electrons. This protective film 14 is usually made from magnesium oxide (MgO).

The address electrodes X1 to Xm are formed on a lower substrate 18 in a direction crossing the scan electrodes Y1 to Yn and the sustain electrodes. A lower dielectric layer 17 and barrier ribs 15 are formed on the lower substrate 18. A phosphorous material layer 16 is formed on the surfaces of the lower dielectric layer 17 and the barrier ribs 15. The barrier ribs 15 are formed in a stripe or lattice shape to physically divide the discharge cells 1, thereby shutting off electrical and optical interferences between the adjacent discharge cells 1. The phosphorous material layer 16 is excited and radiated by an ultraviolet ray generated during the plasma discharge to generate any one of red, green and blue visible light rays.

An inactive mixture gas, such as He+Xe, Ne+Xe or He+Ne+Xe, for a discharge is injected into a discharge space defined between the upper/lower substrates 10 and 18 and the barrier ribs 15.

Such a PDP makes a time-divisional driving of one frame, which is divided into various sub-fields having a different light-emission frequency, so as to express gray levels of a picture. Each sub-field is again divided into a reset period for uniformly causing a discharge, an address period for selecting a discharge cell and a sustain period for realizing the gray levels depending on the discharge frequency. For instance, when it is intended to display a picture of 256 gray levels, a frame interval equal to 1/60 second (i.e. 16.67 msec) is divided into 8 sub-fields. Each of the 8 sub-fields is again divided into an address period and a sustain period. Herein, the reset period and the address period of each sub-field are equal every sub-field, whereas the sustain period and the discharge frequency are increased at a ration of $2^n$(wherein n=0, 1, 2, 3, 4, 5, 6 and 7) at each sub-field in proportion to the number of sustaining pulses. As the sustain period is differentiated at each sub-field as mentioned above, gray levels of a picture can be implemented.

FIG. 3 schematically shows a driving apparatus for the PDP.

Referring to FIG. 3, the driving apparatus for the PDP includes a gain adjuster 32, an error diffuser 33 and a sub-field mapping unit 34 connected between a first inverse gamma adjuster 31A and a data aligner 35, and an average picture level (APL) calculator 36 connected between a second inverse gamma adjuster 31B and a waveform generator 37.

Each of the first and second inverse gamma adjusters 31A and 31B makes an inverse gamma correction of digital video data RGB from an input line 30 to thereby linearly convert brightness according to gray level values of image signals.

The gain adjuster 32 adjusts an effective gain for each of red, green and blue data to thereby compensate for a color temperature.

The error diffuser 33 diffuses a quantization error of the digital video data RGB inputted from the gain adjuster 32 into the adjacent cells to thereby make a fine control of a brightness value.

The sub-field mapping unit 34 maps a data from the error diffuser 33 onto a sub-field pattern stored in advance for each bit and applies the mapped data to the data aligner 35.

The data aligner 35 applies digital video data inputted from the sub-field mapping unit 34 to a data driving circuit of the PDP 38. The data driving circuit is connected to the data electrodes of the PDP 38 to latch a data from the data aligner 35 for each one horizontal line and then apply the latched data to the data electrodes of the PDP 38 for each one horizontal period.

The APL calculator 36 calculates an average brightness per frame of digital video data RGB inputted from the second inverse gamma adjuster 31B, that is, an average picture level (APL), and outputs information about the number of sustaining pulses corresponding to the calculated APL.

The waveform generator 37 generates a timing control signal in response to the information about the number of sustaining pulses from the APL calculator 36, and applies the timing control signal to a scan driving circuit and a sustain driving circuit (not shown). The scan driving circuit and the sustain driving circuit apply a sustaining pulse to the scan electrodes and the sustain electrodes of the PDP 38 during the sustain period in response to the timing control signal from the waveform generator 38.

In such a conventional PDP, a sustaining pulse calculated by the APL is applied to the discharge cells 1 irrespectively of a load of each sub-field. If a sustaining pulse determined by the APL is applied irrespectively of a load of each sub-field, then unnecessary power consumption occurs. For instance, when a full black is expressed at the panel 36, a discharge is not generated at each discharge cell 1 of the panel 38. However, the PDP has a problem in that, since a sustaining pulse is applied to each sub-field even in the above-mentioned case, power is unnecessarily wasted. In other words, the conventional PDP applies a sustaining pulse to a sub-field at which the sustain discharge is not generated, thereby causing a lot of power consumption.

DISCLOSURE OF INVENTION

Accordingly, it is an object of the present invention to provide an apparatus and method of driving a plasma display panel that is adaptive for reducing power consumption.

In order to achieve these and other objects of the invention, a driving apparatus for a plasma display panel, in which one frame has a plurality of sub-fields, according to one aspect of the present invention includes sub-field mapping means for mapping a data inputted from the exterior thereof onto a sub-field pattern stored in advance; an APL calculator for calculating an APL corresponding to said data inputted from the exterior and generating an information about the number of sustaining pulses corresponding to the calculated APL; a load detector for receiving the mapped data from the sub-field mapping means to generate a control signal in response to whether or not a data for each sub-field is supplied; and a waveform generator for controlling a sustaining pulse applied to a panel in response to said information about the number of sustaining pulses and said control signal.

In the driving apparatus, the load detector generates said control signal in correspondence with a sub-field to which said data is not supplied, of the plurality of sub-fields.

The waveform generator makes a control such that said sustaining pulse is not applied during a sustaining period of a sub-field corresponding to said control signal while said sustaining pulse is applied during sustaining periods of the remaining sub-fields.

A method of driving a plasma display panel, in which one frame has a plurality of sub-fields, according to another aspect of the present invention includes the steps of checking a specific sub-field to which a data is not supplied from the plurality of sub-fields; and making a control such that a sustaining pulse is not applied during a sustain period of the specific sub-field.

In the method, said sustaining pulse is applied during sustain periods of the remaining sub-fields other than the specific sub-field.

According to the present invention, a sustaining pulse is not applied during a sustain period of a sub-field to which a data is not supplied, so that it becomes possible to prevent an unnecessary waste of power.

BRIEF DESCRIPTION OF DRAWINGS

These and other objects of the invention will be apparent from the following detailed description of the embodiments of the present invention with reference to the accompanying drawings, in which.

BEST MODE FOR CARRYING OUT THE INVENTION

Reference will now be made in detail to the preferred embodiments of the present invention, examples of which are illustrated in the accompanying drawings.

Hereinafter, the preferred embodiments of the present invention will be described in detail with reference to FIGS. 4 to 6.

Figure 1:
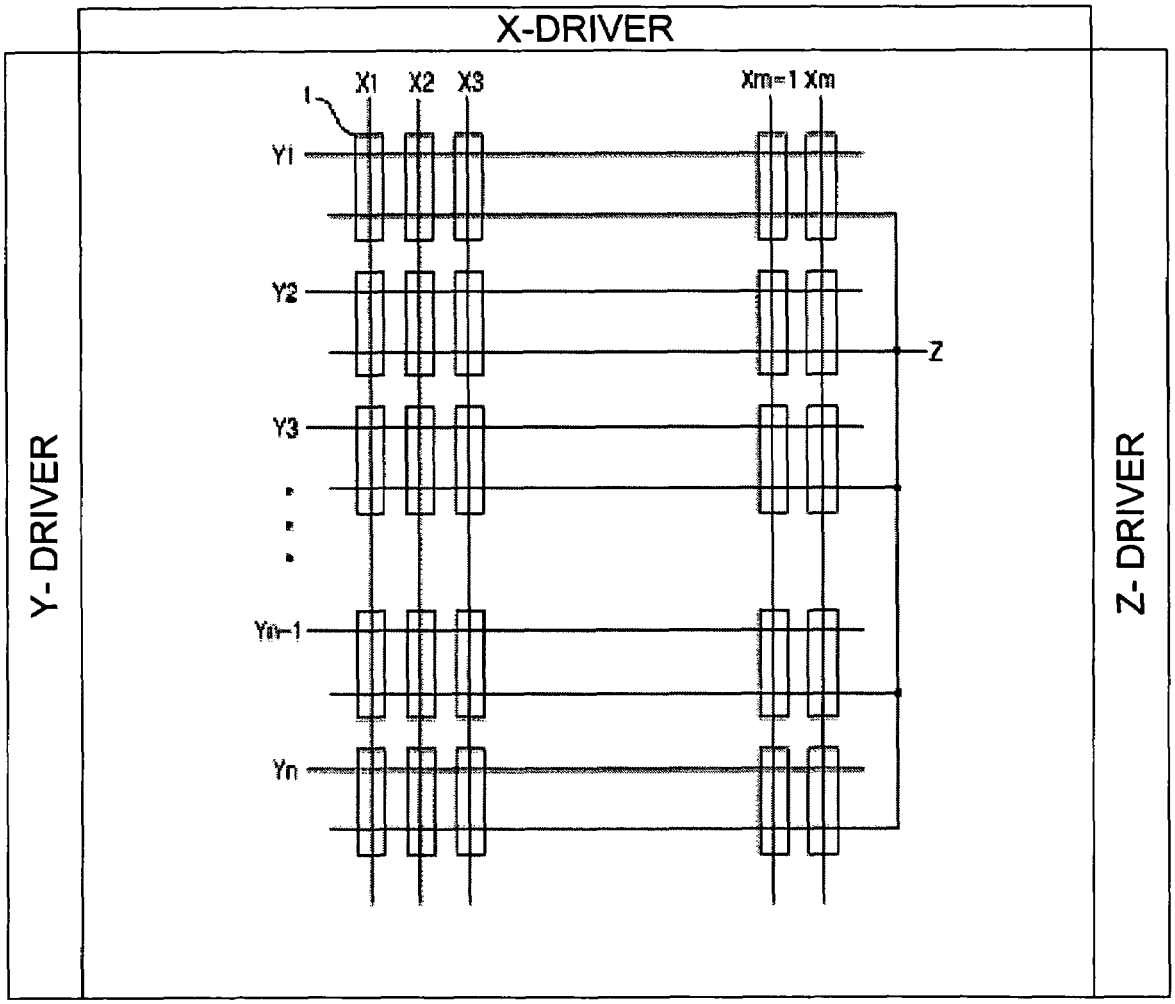
FIG. 1 RELATED ART
FIG. 1 is a schematic plan view showing a configuration of a conventional plasma display panel.
Figure 2:
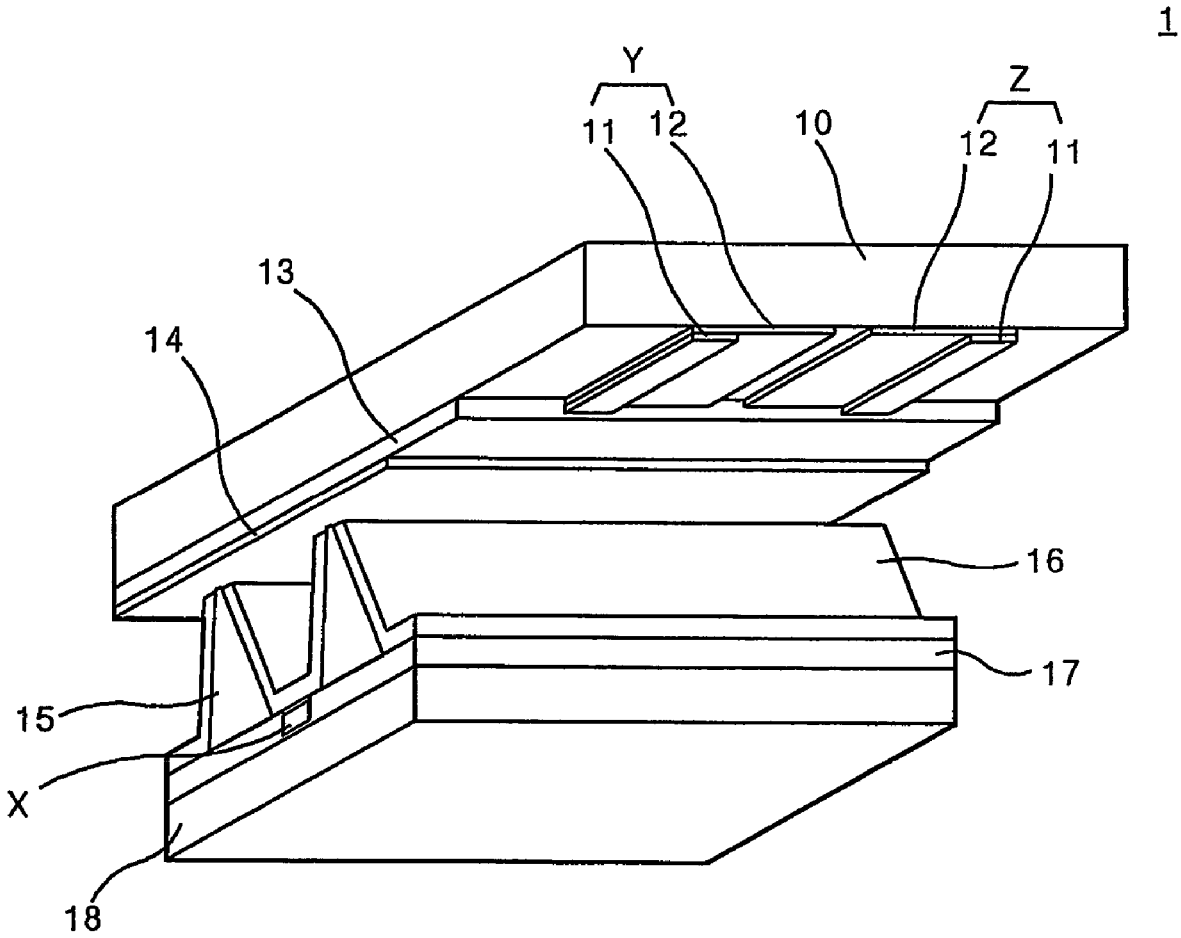
FIG.2 RELATED ART
FIG. 2 is a detailed perspective view showing a structure of the cell shown in FIG. 1.
Figure 3:
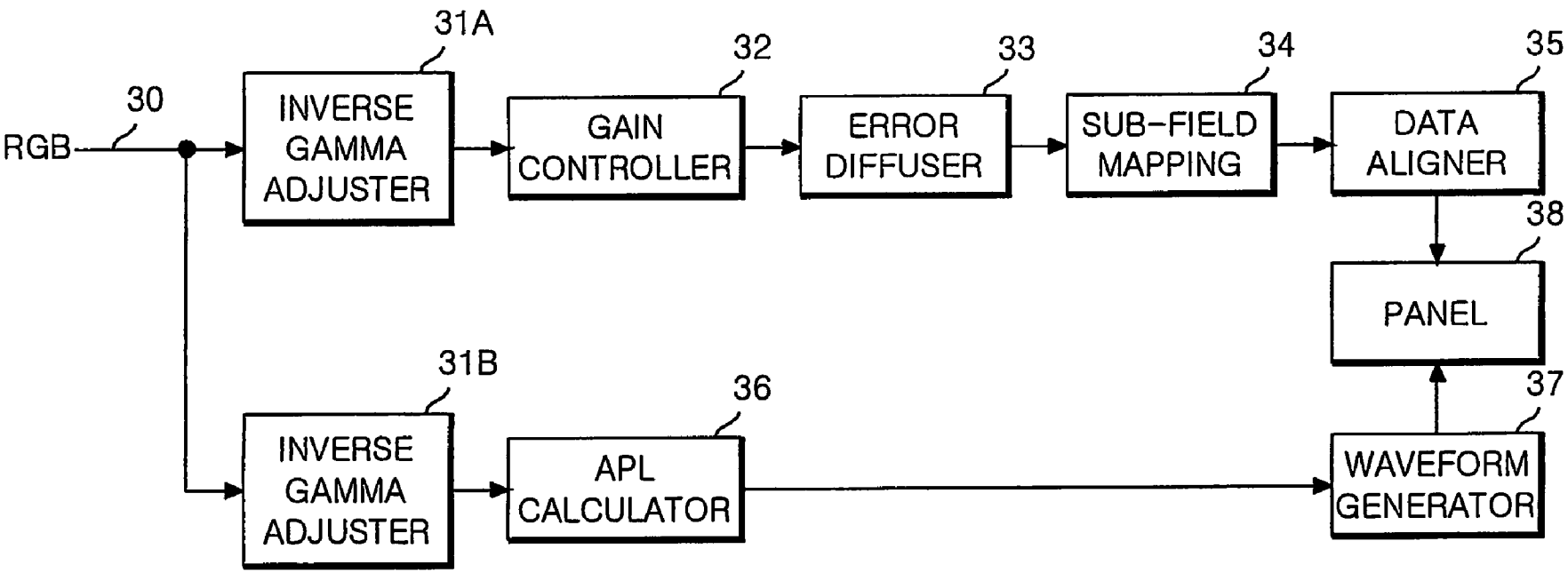
FIG.3 RELATED ART
FIG. 3 is a block diagram showing a configuration of a driving apparatus for the conventional plasma display panel.
Figure 4:
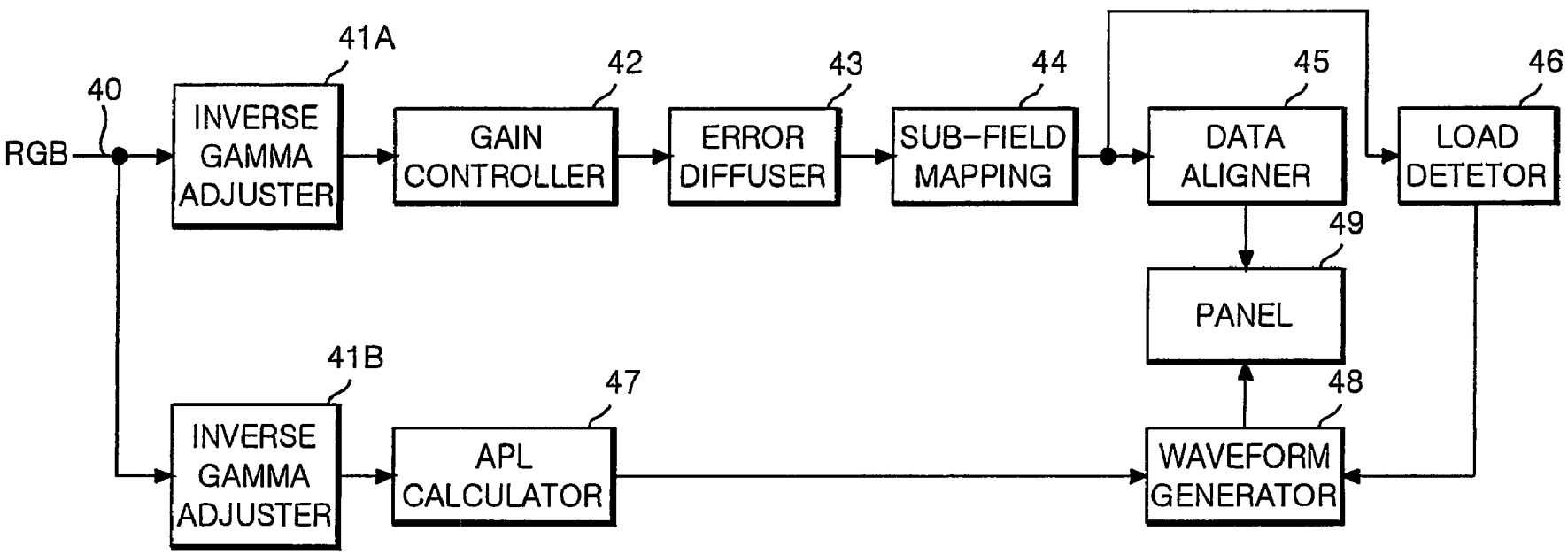
FIG. 4 is a block diagram showing a configuration of a driving apparatus for a plasma display panel according to an embodiment of the present invention.

FIG. 4 is a block diagram showing a configuration of a driving apparatus for a plasma display panel according to an embodiment of the present invention.

Referring to FIG. 4, the PDP driving apparatus according to the embodiment of the present invention includes a gain adjuster 42, an error diffuser 43 and a sub-field mapping unit 44 that are connected between a first inverse gamma adjuster 41A and a data aligner 45, and an average picture level (APL) calculator 47 connected between a second inverse gamma adjuster 41B and a waveform generator 48, and a load detector 46 connected between a sub-field mapping unit 44 and a waveform generator 48.

Each of the first and second inverse gamma adjusters 41A and 41B makes an inverse gamma correction of digital video data RGB from an input line 40 to thereby linearly convert brightness according to gray level values of image signals.

The gain adjuster 42 adjusts an effective gain for each of red, green and blue data to thereby compensate for a color temperature.

The error diffuser 53 diffuses a quantization error of the digital video data RGB inputted from the gain adjuster 52 into the adjacent cells to thereby make a fine control of a brightness value.

The sub-field mapping unit 44 maps a data from the error diffuser 53 onto a sub-field pattern stored in advance for each bit, and applies the mapped data to a data aligner 55.

The data aligner 45 applies digital video data inputted from the sub-field mapping unit 44 to a data driving circuit of the panel 49. The data driving circuit is connected to the data electrodes of the panel 49 to latch a data from the data aligner 45 for each one horizontal line and then apply the latched data to the data electrodes of the panel 49 for each one horizontal period.

The APL calculator 47 calculates an average brightness per frame, that is, an average picture level (APL) with respect to digital video data RGB inputted from the second inverse gamma controller 41B, and outputs information about the number of sustaining pulses corresponding to the calculated APL.

The load detector 46 generates a control signal in correspondence with a load of a data mapped by the sub-field mapping unit 44, and applies the generated control signal to the waveform generator 48. In real, the load detector 46 determines whether or not a data is supplied for each sub-field. If a data is supplied to the sub-field, then the load detector 46 generates a control signal to apply it to the waveform generator 48. In other words, the load detector 46 detects a sub-field to which a data is not supplied (or a sub-field in which a sustain discharge is not generated), and generates a control signal in correspondence with the detected sub-field.

The waveform generator 48 generates a timing control signal in response to the information about the number of sustaining pulses from the APL calculator 47, and applies the timing control signal to a scan driving circuit and a sustain driving circuit (not shown). The scan driving circuit and the sustain driving circuit apply a sustaining pulse to the scan electrodes and the sustain electrodes of the panel 49 during the sustain period in response to the timing control signal from the waveform generator 57.

Meanwhile, the waveform generator 48 controls the scan driving circuit and the sustain driving circuit such that, when a control signal is inputted from the load detector 46, a sustaining pulse is not applied during the sustaining period of the sub-field corresponding to the control signal. In other words, the waveform generator 48 controls them such that a sustaining pulse is not applied during the sustain period of the sub-field corresponding to a control signal from the load detector 46, thereby preventing an unnecessary power consumption.

An operation procedure of the load detector 46 and the waveform generator 48 will be described in detail with reference to FIG. 5 below.

Figure 5:
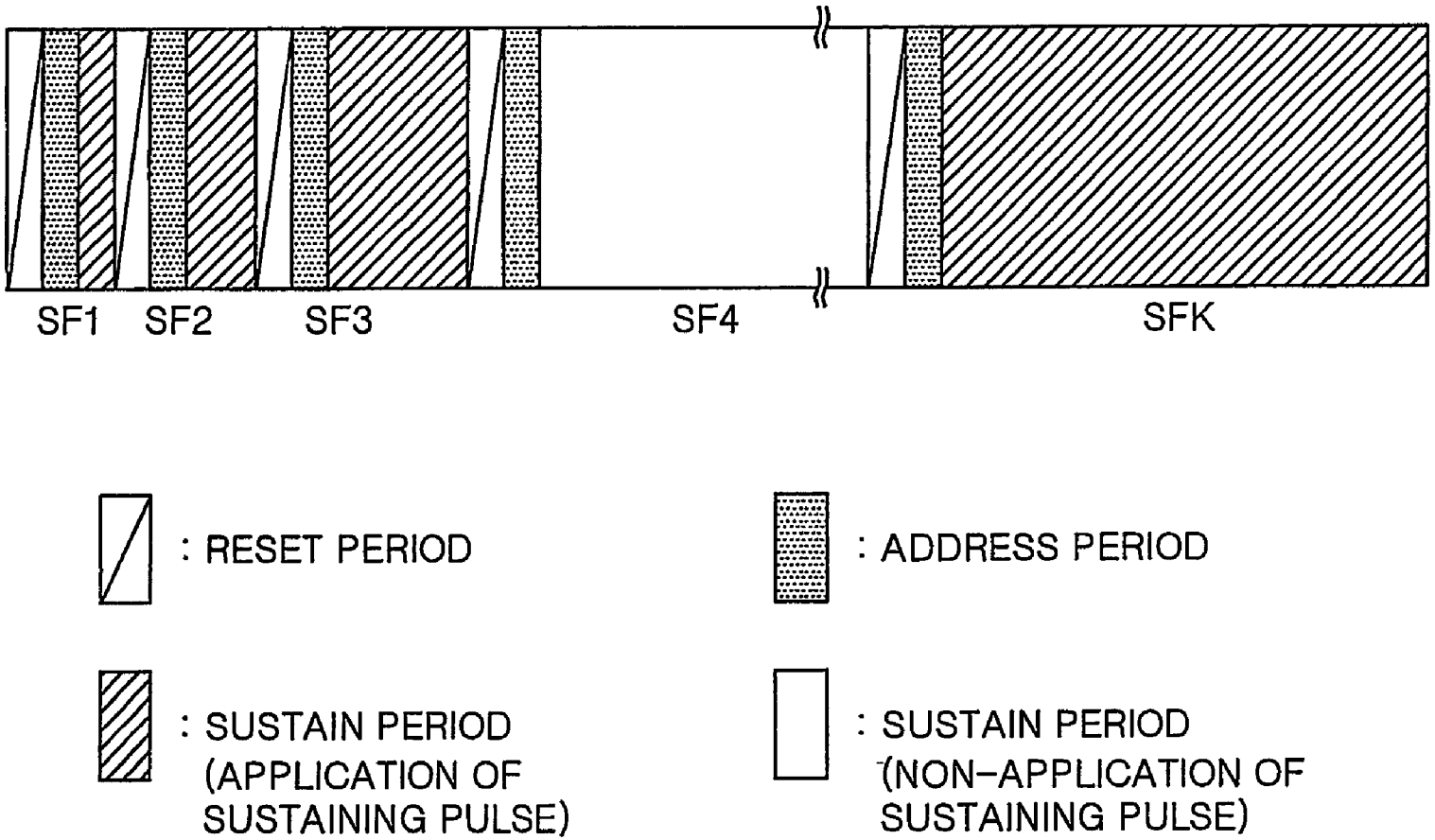
FIG. 5 and FIG. 6 depict a sustaining pulse controlled by the driving apparatus shown in FIG. 4.
Figure 6:
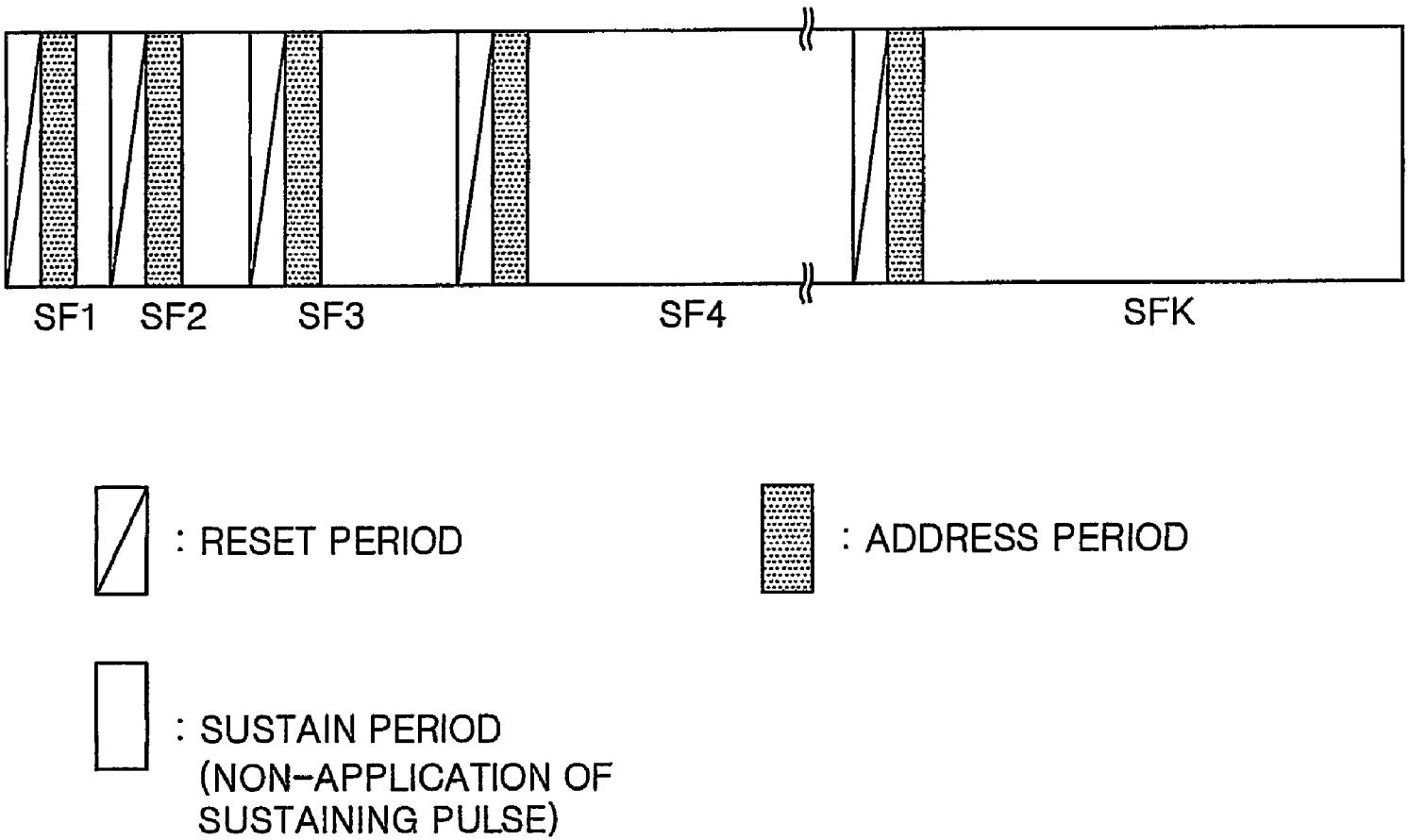

First, it is assumed that a data is not supplied to the fourth sub-field SF4 while a data is supplied to the remaining sub-fields SF1 to SF3 and SF5 to SFk in FIG. 5.

In the reset period included in each sub-field SF, a predetermined initializing pulse is applied to the scan electrode to thereby initialize the discharge cell. In the address period, a data pulse corresponding to the data is applied to the address electrode to thereby select a discharge cell to be turned on. Further, in the sustain period, a sustaining pulse corresponding to the APL is applied to cause a sustain discharge at the discharge cells selected in the address period.

The load detector 46 refers a data mapped for each sub-field to generate a control signal. Herein, since a data is not supplied only during an interval of the fourth sub-field SF4, the load detector 46 generates a control signal in correspondence with an interval of the fourth sub-field SF4. The waveform generator 48 controls the scan driving circuit and the sustain driving circuit to apply sustaining pulses having the number corresponding to the APL during the sustain period. Further, the waveform generator 48 controls the scan driving circuit and the sustain driving circuit such that a sustaining pulse is not applied during a time interval of the sub-field corresponding to a control signal from the load detector 46, that is, the fourth sub-field SF4. Thus, a sustaining pulse is not applied in the sustain period of the fourth sub-field SF4, so that it becomes possible to prevent an unnecessary power consumption. In real, in the embodiment of the present invention, when a full black is expressed during one frame at the panel 49, a sustaining pulse is not applied during the sustain periods of all the sub-fields SF included in said frame as shown in FIG. 6.

Although the present invention has been explained by the embodiments shown in the drawings: described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

In an alternative embodiment, the plasma display device comprises a Plasma Display Panel (PDP) having scan electrodes, sustain electrodes and address electrodes; a first driving circuit that selects discharge cells by applying a first voltage to the address electrodes during an address period; and a second driving circuit configured for driving at least one of the scan electrodes or the sustain electrodes that emits light in the discharge cells by alternatively applying a second voltage to the scan electrodes and the sustain electrodes during an sustain period, wherein the second driving circuit does not apply a second voltage to the scan electrodes and the sustain electrodes, in at least one sub-field out of one frame. Further, the first voltage is not applied in the at least one sub-field.

Alternatively, a plasma display device comprises a Plasma Display Panel (PDP) having scan electrodes, sustain electrodes and address electrodes; a first driving circuit that selects discharge cells by applying a first voltage to the address electrodes during an address period; and a second driving circuit configured for driving at least one of the scan electrodes or the sustain electrodes that emits light in the discharge cells by alternatively applying a second voltage to the scan electrodes and the sustain electrodes during an sustain period, wherein the second driving circuit does not apply a second voltage to the scan electrodes and the sustain electrodes when a number of the discharge cells in the address period is lower than 20% of entire cells, in at least one sub-field out of one frame.

Further, a method for driving a plasma display device using a plurality of sub-fields, the plasma device having scan electrodes, sustain electrodes and address electrodes comprises selecting discharge cells during an address period by applying a first voltage to the address electrodes; and emitting light in the discharge cells by alternatively applying a second voltage to the scan electrodes and the sustain electrodes during an sustain period, wherein when a number of discharge cells in the address period is lower than 20% of entire cells, the second voltage is not applied during the sustain period, in at least one sub-field out of one frame.

The invention claimed is:

1. A driving apparatus for a plasma display panel in which one frame has a plurality of sub-fields, said apparatus comprising: sub-field mapping means for mapping a data inputted from the exterior thereof onto a sub-field pattern stored in advance; an APL calculator for calculating an APL corresponding to said data inputted from the exterior and generating an information about the number of sustaining pulses corresponding to the calculated APL; a load detector for receiving the mapped data from the sub-field mapping means to generate a control signal in response to whether or not a data for each sub-field is supplied; and a waveform generator for controlling a sustaining pulse applied to a panel in response to said information about the number of sustaining pulses and said control signal.

2. The driving apparatus as claimed in claim 1, wherein the load detector generates said control signal in correspondence with a sub-field to which said data is not supplied, of the plurality of sub-fields.

3. The driving apparatus as claimed in claim 2, wherein the waveform generator makes a control such that said sustaining pulse is not applied during a sustaining period of a sub-field corresponding to said control signal while said sustaining pulse is applied during sustaining periods of the remaining sub-fields.

4. A plasma display panel comprising:

a first substrate;

a plurality of first electrodes provided on the first substrate;

a plurality of second electrodes provided on the first substrate, the first and second electrodes being provided in a first direction;

a second substrate;

a plurality of address electrodes provided on the second substrate in a second direction, the first direction being different from the second direction;

a plurality of barrier ribs provided on the second substrate in the second direction;

a plurality of discharge cells, each cell provided between two adjacent barrier ribs, and having corresponding first, second and address electrodes;

a first circuit for driving the address electrodes;

a second circuit for driving at least one of the first electrodes or the second electrodes, wherein during at least one sub-field of a frame, at least one sub-field having an address period and a sustain period, the second circuit omit sustain signals to at least one of the first electrodes or the second electrodes during the sustain period of the at least one sub-field to provide a constant voltage.

5. The plasma display panel of claim 4, wherein the at least one sub-field of the frame further comprises a reset period.

6. The plasma display panel of claim 4, wherein a gray level is full black.

7. The plasma display panel of claim 4, wherein the constant voltage is a ground potential.

8. A method of driving a plasma display panel, comprising:

driving a plasma display panel based on a plurality of sub-fields within a frame to provide a gray level in a plasma display panel, each sub-field having an address period and a sustain period, the plasma display panel having a first substrate, a plurality of first electrodes provided on the first substrate, a plurality of second electrodes provided on the first substrate, the first and second electrodes being provided in a first direction, a second substrate, a plurality of address electrodes provided on the second substrate in a second direction, the first direction being different from the second direction, a plurality of barrier ribs provided on the second substrate in the second direction, a plurality of discharge cells, each cell provided between two adjacent barrier ribs, and having corresponding first, second and address electrodes, driving the address electrodes using a first circuit during the address period of at least one sub-field, and driving at least one of the first electrodes or the second electrodes using a second circuit during the sustain period of the at least one sub-field, wherein the second circuit provides a constant voltage to at least one of the first electrodes or the second electrodes during entire period of the sustain period of the at least one sub-field.

9. The method of claim 8, wherein the at least one sub-field of the frame further comprises a reset period.

10. The method of claim 8, wherein a gray level is full black.

11. The method of claim 8, wherein the constant voltage is a ground potential.

* * * * *